US005400994A

United States Patent [19]

Shawwaf et al.

[11] Patent Number: 5,400,994

[45] Date of Patent: Mar. 28, 1995

[54] YIELDABLE ROOF SUPPORT SYSTEM

[75] Inventors: Khaled Shawwaf, New York, N.Y.; Johann Wlodkowki, Chicago, Ill.; Thomas Herbst, Bavaria, Germany; Ray Brandon, Grand Junction, Colo.

[73] Assignee: Dyckerhoff & Widmann AG of Munich, Munich, Germany

[21] Appl. No.: 867,150

[22] Filed: Apr. 10, 1992

Related U.S. Application Data

[63] Continuation-in-part of Ser. No. 645,000, Jan. 22, 1991, abandoned.

[51] Int. Cl.[6] ..... E21D 15/00

[52] U.S. Cl. ..... 248/354.3; 248/548; 405/290

[58] Field of Search ..... 248/345.3, 354.1, 200.1, 248/644, 548; 52/126.1, 126.6, 365; 405/290, 288, 230, 259.1–259.6; 403/2

[56] References Cited

U.S. PATENT DOCUMENTS

| | | | |
|---|---|---|---|
| 1,006,163 | 10/1911 | Winz | 248/548 |
| 2,504,291 | 4/1950 | Alderfer | 248/354.3 |
| 2,535,956 | 12/1950 | Roggensack | 248/354.3 |
| 3,737,134 | 6/1973 | Foon | 248/354.3 |
| 4,080,794 | 3/1978 | Neu | 61/45 D |
| 4,249,837 | 2/1981 | Spies | 405/290 |
| 4,255,071 | 3/1981 | Koppers et al. | 405/290 |
| 4,309,130 | 1/1982 | Bemmerl | 405/294 |
| 4,309,131 | 1/1982 | Bollmann | 405/294 |
| 4,352,602 | 10/1982 | Plaga | 405/291 |
| 4,382,721 | 5/1983 | King | 248/548 |
| 4,425,057 | 1/1984 | Hahn | 405/290 |
| 4,534,531 | 8/1985 | Brown | 248/549 |
| 4,565,469 | 1/1986 | Chlumecky | 405/288 |
| 4,601,616 | 7/1986 | Barish et al. | 405/288 |
| 4,630,971 | 12/1986 | Herbst et al. | 405/260 |
| 4,662,795 | 5/1987 | Clark et al. | 405/261 |
| 4,741,505 | 5/1988 | Anderson | 248/354.3 |
| 5,015,125 | 5/1991 | Seegmiller | 405/150 |

FOREIGN PATENT DOCUMENTS

| | | | |
|---|---|---|---|
| 378823 | 10/1985 | Austria . | |
| 416872 | 10/1910 | France . | |
| 15606 | 8/1912 | France . | |
| 16276 | 10/1912 | France | 248/354.3 |
| 992041 | 10/1951 | France | 248/354.3 |
| 3314858A1 | 10/1984 | Germany . | |
| 368610 | 5/1963 | Switzerland | 248/354.3 |
| 1517037 | 7/1978 | United Kingdom | 405/288 |
| 2045312 | 10/1980 | United Kingdom | 405/290 |
| 2099040 | 12/1982 | United Kingdom | 405/290 |

OTHER PUBLICATIONS

*Coal Magazine*, Jun. 1990, pp. 136, 137.

Jennmar Corp. Brochure.

*Coal Age*, Mar. 1987, pp. 30–33.

Sketches entitled "Design of Yieldable Anchor Heads".

Brochure entitled "Yippi-Yieldable Steel Post" by Western Support Systems of Salt Lake City, Utah, 8–91.

Advertisement entitled Heintzmann Schnellspan -Stütze/Super-Prop (two pages, not dated).

*Primary Examiner*—Karen J. Chotkowski

*Attorney, Agent, or Firm*—Marshall, O'Toole, Gerstein, Murray & Borun

[57] ABSTRACT

A support includes a base member having an open end and a hollow interior, a forcing member having an end extending through the open end of the base member into the hollow interior thereof and having threads thereon and a mandrel or sliding nut capable of engaging the threads of the forcing member at an adjustable position and providing an interfering relationship between the base and forcing members as a compressive load is applied thereto. The support is particularly adapted for use in supporting the roof of a mine.

29 Claims, 6 Drawing Sheets

Fig. 4
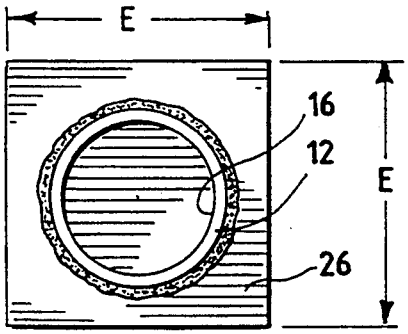
Fig. 5
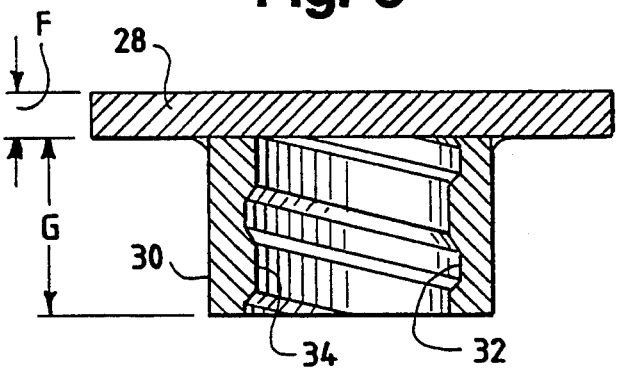
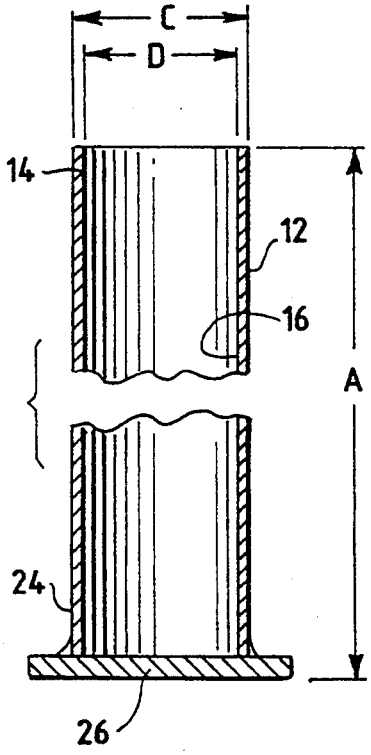
Fig. 3
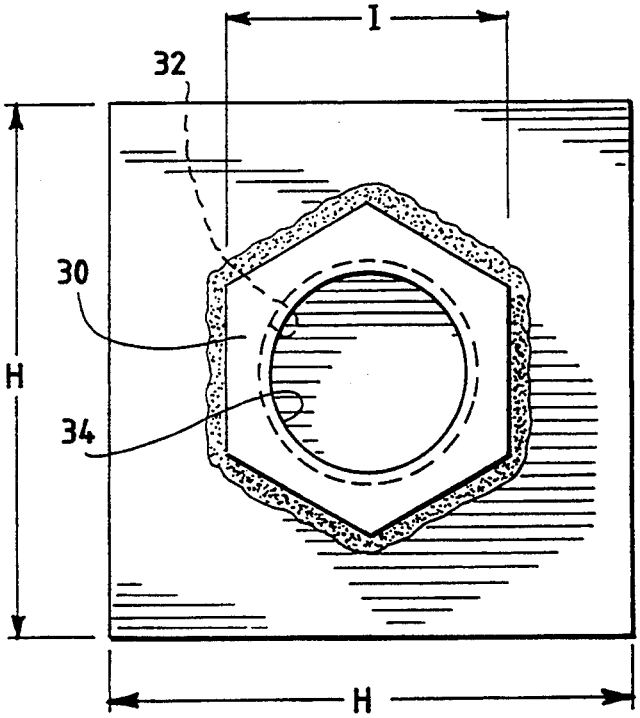
Fig. 6

Fig. 7
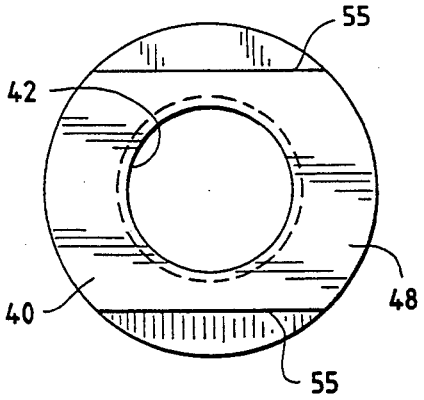
Fig. 10
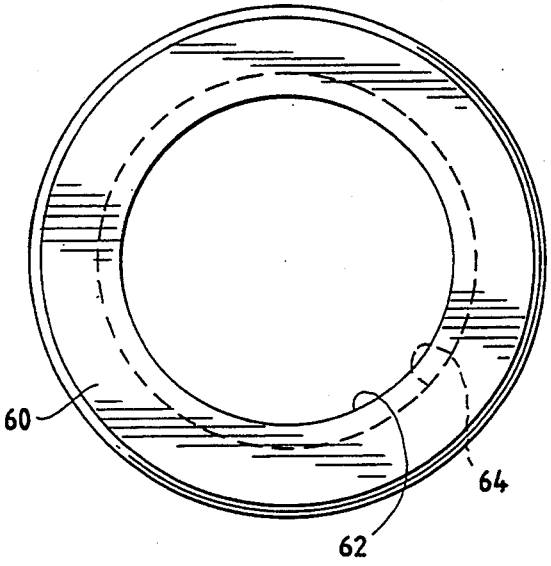
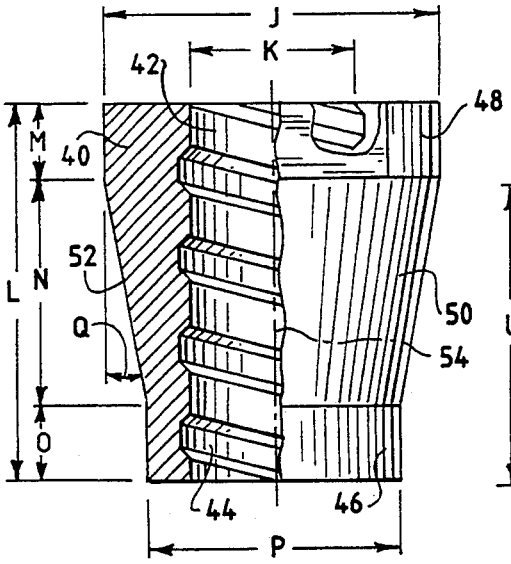
Fig. 8
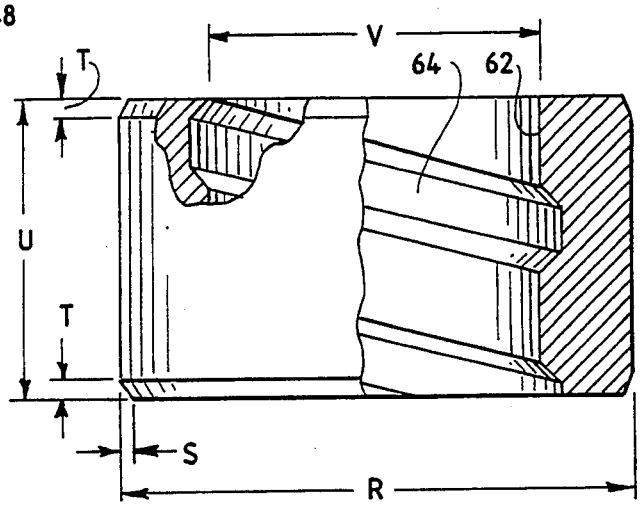
Fig. 9

YIELDABLE ROOF SUPPORT SYSTEM

CROSS-REFERENCE TO RELATED APPLICATION

The present application comprises a continuation-in-part of U.S. patent application Ser. No. 07/645,000, filed Jan. 22, 1991, and entitled "Yieldable Roof Support System", and now abandoned.

TECHNICAL FIELD

The present invention relates generally to supports, and more particularly to a support that yields in a controlled fashion in response to an applied load.

BACKGROUND ART

There is a need in mining operations, particularly in longwall mines, for a roof support that yields in a controlled fashion in response to roof loads. In the past, mine operators have used post-type roof supports in the form of wood timbers and cribbing. The timbers absorb the initial roof load and the cribbing yields as load is applied thereto so that catastrophic failure of the roof support is prevented. This type of roof support system is one attempt to approximate an ideal system which would be very stiff to handle the initial load and yet have the ability to yield in a controlled fashion. However, timbers and cribbing present a fire hazard, are expensive and are labor intensive. Also, timbers and cribbing occupy a relatively large volume of space and can thus interfere with ventilation and complicate movement of materials and personnel into and out of a mine.

A yieldable steel post for use in supporting a roof of a mine is disclosed in *Coal Magazine*, June 1990, pages 136 and 137. The post includes a bottom leg telescoped within an upper leg wherein each leg comprises a length of pipe. A tapered expansion ring is welded on the lower leg at a desired position and bottom and top plates are welded to the lower and upper legs and are adapted to engage a floor and a roof, respectively, of a mine. As a compressive load is applied to the post, the expansion ring radially deforms the upper leg outwardly as the top leg moves relative to the bottom leg.

A prior art yieldable roof support utilizes an upper slotted leg of hollow pipe telescoped within a lower leg also of hollow pipe. A wedge is driven into the slot in the upper leg at a desired position. The wedge causes the upper leg to have an interference fit with the lower leg at this position. As load is applied to the support, the lower leg is radially deformed by the upper section of leg at the location of the wedge.

A further type of yieldable post is sold by Jennmar Corp. of Pittsburgh, Pa. This type of roof support includes an upper channel nested within a lower channel and one or more clamps that couple the upper and lower channels together.

Other types of roof supports include concrete donuts or cribbing and are described in an article appearing in *Coal Age*, March 1987, pages 30–33.

None of the foregoing post-type roof supports has been found to be entirely satisfactory in terms of expense, ease of manufacture and assembly and support capability.

In addition to post-type supports, anchor-type yieldable roof supports for tunnels and the like have been designed wherein a supporting rod extending through the surface of the rock into the tunnel includes a deformation member carried on one end of the rod in axial alignment with a steel tube. When the rod is placed in tension, the deformation member is deflected within the steel tube, thereby deforming the tube radially outwardly and permitting limited movement of the rod. Such a design is shown in Austrian Patent 378,823.

West German published patent specification 33 14 858 A1 discloses a yieldable roof support including a rod having a series of stepped portions separated by tapered portions on one end thereof disposed within a steel tube. The stepped and tapered sections deform the steel tube radially outwardly when the rod is placed in tension.

SUMMARY OF THE INVENTION

A yieldable support for a compressive load is capable of deflecting in a controlled fashion as a load is applied thereto and is readily adaptable to many different load conditions.

More particularly, a support comprises a base member having an open end and an inner wall of a first cross-sectional size defining a hollow interior and a forcing member having threads thereon and an end extending through the open end of the base member into the hollow interior thereof. Means are provided having a second cross-sectional size larger than the first cross-sectional size and capable of engaging the threads of the forcing member at an adjustable position and movable into the interior of the base member for expanding the inner wall outwardly at a point of contact of the expanding means with the inner wall of the base member as a compressive load is applied to the forcing member.

Preferably, according to one aspect of the present invention, the providing means comprises a tapered mandrel having a threaded bore therethrough in engagement with the threads on the forcing member. Also preferably, the mandrel and the base member are circular in cross-section, the base member has an inner diameter of a first size throughout its length and the mandrel has an outer diameter of a second size less than the first size at one end thereof and a third size greater than the first size at another end thereof. Further in accordance with the preferred embodiment, the outer diameter of the mandrel increases linearly from the second size to the third size over a portion of its length.

If desired, means may be carried by the forcing member and disposed within the base member for centering the forcing member as relative movement occurs between the members in response to application of load thereto. In accordance with one embodiment, the centering means preferably comprises a cylindrical nut disposed on the ends of the forcing member.

In accordance with another embodiment, means are provided for connecting the providing means to the centering means. The providing means preferably comprises a tapered mandrel having a threaded bore therethrough in engagement with the threads on the forcing member. Further, the centering means may comprise a cylindrical member and the connecting means may comprise an axial member. The centering means may further include axial grooves in the outer wall thereof that prevent portions of lubricant applied to an inner wall of the base member from being removed from such wall as relative movement between the members occurs.

Still further in accordance with this aspect of the present invention, the forcing member preferably comprises a threaded bar and the base member comprises a pipe which is radially expanded by the forcing member during relative movement of the members.

In accordance with a further aspect of the present invention, the providing means comprises a sliding nut and the base member has an inner diameter of a first size and the sliding nut has an outer diameter of a second size larger than the first size. Preferably, the sliding nut includes a bore therethrough having threads in engagement with the forcing member threads wherein the forcing member threads have a first shear strength and the bore threads have a second shear strength greater than the first shear strength so that the bore threads shear off the forcing member threads as load is applied to the members.

Preferably, means are carried by the forcing member and disposed within the base member for centering the forcing member as relative movement occurs between the members in response to application of load thereto. In accordance with this aspect of the present invention, the sliding nut and the end of the base member are complementarily shaped to assist in centering of the forcing member.

In accordance with yet another aspect of the present invention, a method of making a roof support for a mine includes the steps of providing a base member having an open end and a hollow interior wherein the hollow interior has a first cross-sectional size, providing a threaded rod and providing a body having a second cross-sectional size larger than the first cross-sectional size. The method further includes the steps of threading the body on the rod and forcing the body and an end of the rod through the open end of the base member into the hollow interior thereof such that the base member is outwardly deformed by the body and the body and the rod are retained within the base member.

Preferably, lubricant is applied to an inner wall of the base member prior to the step of forcing the body into the end of the base member. Also preferably, a centralizer is joined to the body and the centralizer is threaded on the rod with the body.

Still further, grooves may be provided in an outer surface of the centralizer wherein the grooves prevent portions of lubricant from being removed from the inner wall of the base member as a relative movement between the members occurs.

Further, means may be provided for limiting relative movement of the members wherein the limiting means comprises a nut carried by the forcing member.

The support of the present invention is simple in design and effective to yieldably support compressive loads. Also, the length thereof may be easily adjusted so that mine roofs of differing heights can be accommodated.

BRIEF DESCRIPTION OF THE DRAWINGS

FIG. 3 comprises a sectional view of the base member of FIGS. 1 and 2;

FIG. 4 comprises a plan view of the base member;

FIG. 5 comprises a sectional view of the top plate of FIGS. 1 and 2;

FIG. 6 comprises a bottom view of the top plate of FIG. 7;

FIG. 7 comprises a partial sectional view of the mandrel of FIGS. 1 and 2;

FIG. 8 comprises a plan view of the mandrel;

FIG. 9 comprises a partial sectional view of the cylindrical nut of FIGS. 1 and 2;

FIG. 10 comprises a plan view of the cylindrical nut;

DESCRIPTION OF THE PREFERRED EMBODIMENTS

Figure 1:
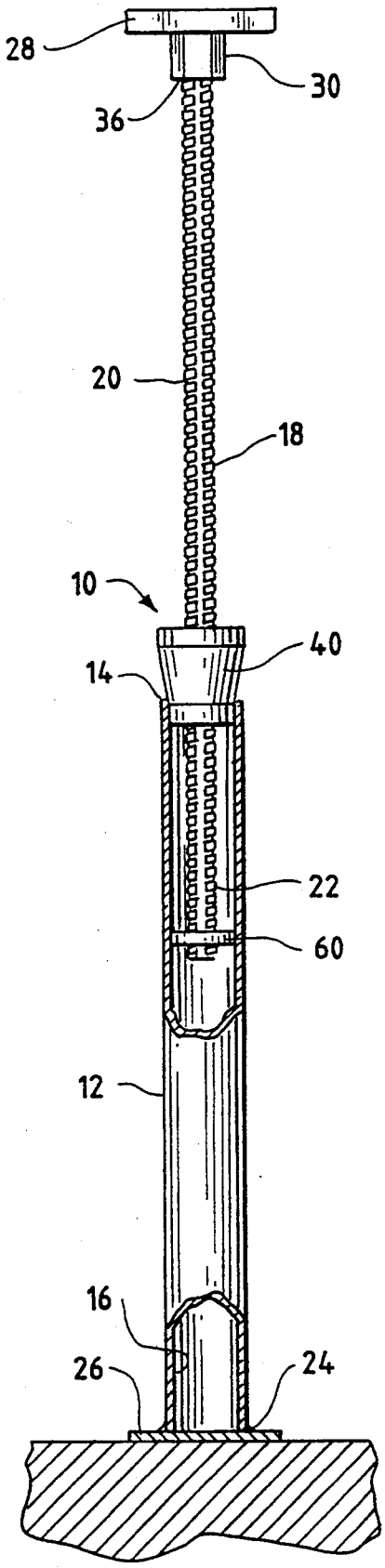
FIG. 1 comprises an elevational view, partly in section, of a support according to the present invention before application of load thereto.

Referring now to FIG. 1, a support 10 for supporting a compressive load, such as a roof of a mine, includes a base member 12 having an open end 14 and a hollow interior 16 and a forcing member 18 in the form of a bar having a series of threads 20 thereabout wherein a . first end 22 of the bar extends through the first end 14 of the base member 12 into the hollow interior 16.

Referring now to FIGS. 3 and 4, the base member 12 may comprise a section of ordinary pipe. In one example of the present invention adapted to support a particular roof load, the base member 12 comprises seamless or butt welded carbon steel pipe constructed in accordance with one or more of ASTM standards A53, A106 and A120, Schedule 40. Welded to a second end 24 of the base member 12 is a steel bottom plate 26 which is adapted to rest on a floor of a mine.

Referring now to FIGS. 5 and 6, a top plate 28 is welded to a hexagonal lock nut 30 which has a series of female threads 32 surrounding a bore 34. The female threads 32 accept the threads 20 of the bar 18 located at a second end 36 thereof. The top plate 28 is adapted to engage a roof of a mine.

It should be noted that the bottom plate 26, the top plate 28 and the lock nut 30 are optional in the sense that the base member 12 and bar 18 may be secured to a floor and roof of a mine or other structures, such as a truss, by different means, if desired.

Referring again to FIG. 1, means in the form of a mandrel 40 is capable of engaging the threads 20 of the bar 18 at an adjustable position and provides an interfering relationship between the base member 12 and the bar 18 as a compressive load applied thereto. More specifically, and with reference to FIGS. 7 and 8, the mandrel 40 includes a bore 42 therethrough having female threads 44 disposed thereabout which are sized to accept the threads 20 of the bar 18. The mandrel 40 is preferably circular in cross-section and includes a first end 46 of a first size or diameter, a second end 48 of a second size or diameter and an intermediate portion 50. Preferably, the diameter of the intermediate portion 50 increases linearly (i.e. uniformly) from the first diameter 46 to the second diameter 48, although the diameter may increase in other than a linear fashion, if desired. The mandrel 40 thus includes an outer surface 52 which is tapered and forms a certain angle with respect to a longitudinal axis 54 of the mandrel 40.

If desired, flat surfaces 55 may be provided 0n the mandrel 40. The flat surfaces 55 afford engagement of the mandrel 40 by a tool (not shown) so that the mandrel 40 may be turned to permit the position of the mandrel 40 on the bar 18 to be adjusted. This, in turn, permits the height of the support 10 to be adjustably variable so that the support 10 can be used to support mine roofs of differing heights.

Disposed on the first end 22 of the rod 18 is means in the form of a cylindrical nut 60 for centering the bar 18 as relative movement between the bar and pipe occurs in response to the application of compressive load thereto. The cylindrical nut 60 is fabricated of any suitable material, such as metal or plastic, and is shown in greater detail in FIGS. 9 and 10. The nut 60 includes an interior bore 62 having female threads 64 therein adapted to engage the threads 20 on the bar 18.

In the preferred embodiment, the mandrel 40 is fabricated of ductile iron GR 80-55-06 manufactured to ASTM standard A536-80 BHM 187/255. The rod 18 is No. 18 THREADBAR® sold by Dywidag Systems International, U.S.A., Inc., located in Lemont, Ill., a subsidiary of the assignee of the present application, although a different size bar could be used, if desired. Also, in one example of the present invention, the various parts have the dimensions indicated in Table A presented below, although it should be noted that the following dimensions are optional and are not to be construed as limiting the scope of the present invention (reference letters are indicated in the Figures and all dimensions are in inches unless otherwise indicated).

TABLE A

| Reference Letter | Dimension |
|---|---|
| A | 36.000* |
| B | 0.500 |
| C | 4.000 |
| D | 3.548 |
| E | 6.000 |
| F | 0.500 |
| G | 2.000 |
| H | 6.000 |
| I | 3.250 |
| J | 4.535 |
| K | 2.248 |
| L | 5.000 |
| M | 1.000 |
| N | 3.000 |
| O | 1.000 |
| P | 3.423 |
| Q | 10.5 degrees |
| R | 3.423 |
| S | 0.63 |
| T | 0.125 |
| U | 2.000 |
| V | 2.248 |

*The lengths of the base member 12 and the bar 18 depend upon the height of the mine roof above the floor and vary with the particular installation.

Figure 2:
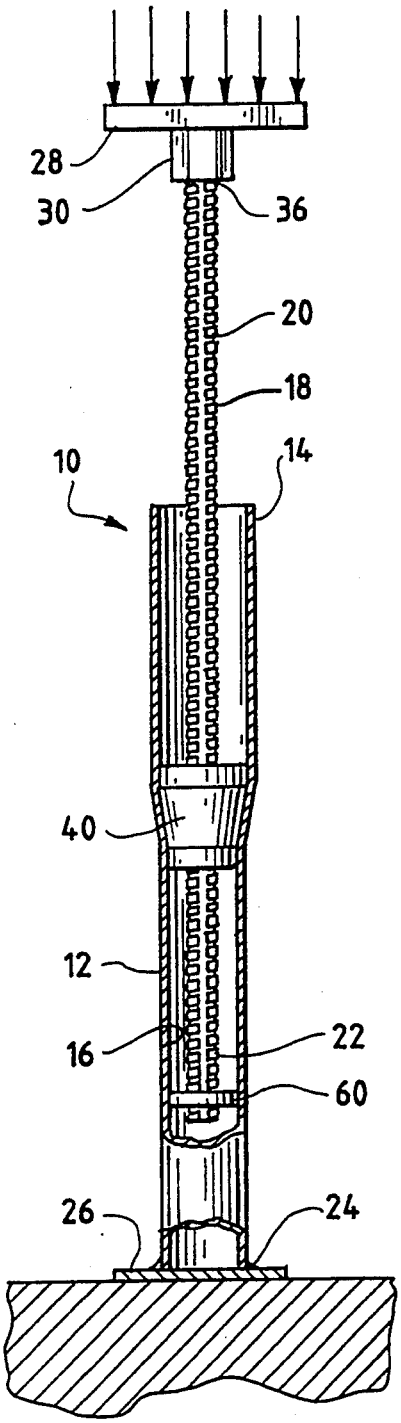
FIG. 2 comprises a view similar to FIG. 1 of the support of the present invention after application of load thereto.

Referring again to FIGS. 1 and 2, before the bar 18 and base member are subjected to compressive loading, the bar 18 is inserted into the base member 12 such that the cylindrical nut 60 and a portion of the mandrel 40 are disposed within the interior 16 of the base member 12. As noted previously, the height of the support 10 is adjusted by turning the mandrel 40 so that the support 10 is disposed between and in contact with the roof and floor of a mine. As a compressive load is applied to the bar 18 and the base member 12, relative movement occurs between the bar 18 and the base member 12 in the axial direction. This axial movement causes radial deformation of the base member 12 due to the interference fit of the mandrel 40. The radial deformation permits the support 10 to yield in response to applied loads in a controlled fashion so that catastrophic failure of the support 10 is prevented. During relative movement of the rod 18 and the base member 12, the cylindrical nut 60 acts to keep the rod 18 centered within the base member 12. As can be seen with reference to FIG. 1, the height of the support 10 prior to relative movement of the rod 18 and the base member 12 may be adjusted by rotating the mandrel 40 on the threads 20 to thereby change the elevation thereof. The support 10 may thus be readily adapted for different roof heights as needed.

The material for the base member 12 and relative dimensions of the mandrel 40 and the base member 12 are selected so that the maximum load carrying capacity of the support 10 is less than the calculated buckling capacity thereof by a desired safety margin. Also, the angle Q shown in the drawings may be any angle that provides the desired load handling capacity, although angles within a range between 7 and 15 degrees have been found to result in a most advantageous arrangement.

When a compressive load is first applied, the mandrel 40 transmits a radially outward force against the walls of the base member 12. The walls of the base member 12 deform as increasing load is applied until the yielding limit of the base member 12 is reached. Thereafter, the support 10 yields and provides a substantially constant and continuous upward force resisting the applied load until the full travel limit of the support 10 is reached.

Figure 11:
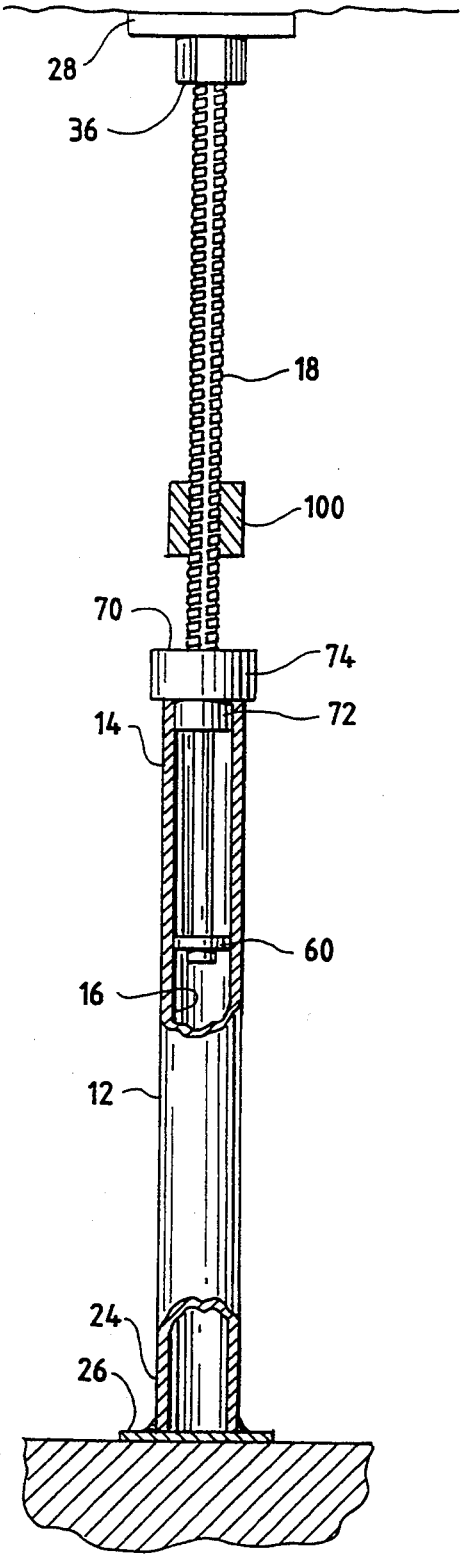
FIG. 11 comprises a view similar to FIG. 1 of a further embodiment of the present invention.

FIG. 11 illustrates an alternative embodiment of the present invention. Elements common between FIGS. 1–10 and 11 are assigned like reference numerals. As with the previous embodiment, the rod 18 extends into the hollow interior 16 of the base member 12. In this embodiment, the base member 12 must have a load carrying capacity in excess of the breaking load limit of the bar 18. Also, the threaded rod is received within a threaded bore of a sliding nut 70. The sliding nut 70 includes a reduced diameter portion 72 which is received within the first end 14 of the base member 12 and a second enlarged diameter portion 74 which is disposed atop the end 14 and which has a diameter at least equal to the inner diameter of the base member 12. The first end of the base member 12 and the sliding nut 70 are complementarily shaped to assist in centering of the rod 18 within the base member 12 during relative movement thereof.

Figure 12:
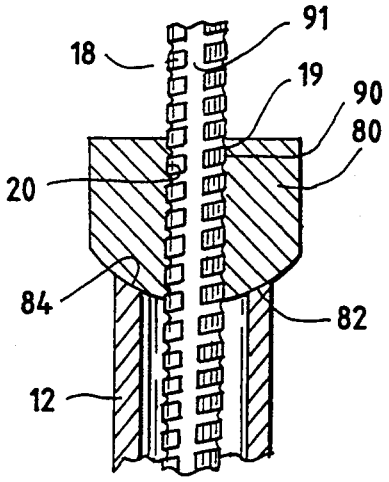
FIG. 12 comprises a fragmentary elevational view, partly in section, of a modification of the embodiment of FIG. 11.

Referring to FIG. 12, the sliding nut 70 may instead be replaced by a different sliding nut 80 having a rounded lower surface 82 which is received within a cylindrical seat 84 formed on end walls of the base member 12. Again, the sliding nut and the end of 14 of the base member 12 are complementarily shaped to assist in centering of the rod 18 within the base member 12. Each of the sliding nuts 70, 80 includes female threads 90 which are shaped to engage the threads 20 on the rod 18. Preferably, although not necessarily, and as seen in FIG. 12, the threads 20 do not extend continuously about the bar 18. Rather, the threads 20 are discontinuous in the sense that adjacent threads 20 are separated from one another at one or more regions 91 extending axially along the bar 18. The threads 90 have a higher shear strength than the threads 20 so that, as a compressive load is applied to the bar 16 and the base member 12, the threads 90 sequentially shear off individual threads 20. This shearing permits relative movement of the bar 18 and the base member 12 in response to applied load so that the support yields in a controlled fashion in response to applied load.

It can be seen that, as with the previous embodiment, yielding is permitted by an interference fit between relatively movable members so that loads can be supported without catastrophic failure of the support.

More particularly, the supports of FIGS. 11 and 12 resist deflection until a load of a magnitude sufficient to shear one of the threads 20 is applied. The upward force resisting the compressive load then drops and thereafter rises until a load magnitude is applied which causes shearing of the next thread 20. The resisting force thereafter rises and falls as threads 20 are sheared, allowing the support to yield in a controlled fashion.

If desired, an optional safety nut 100 may be threaded on the rod 18 at an appropriate height to limit relative movement of the bar 18 and the support member 12. The safety nut 100 is designed to carry a load in excess of the breaking load of the bar 18.

It should be noted that projections other than threads may be used to provide the interference fit between the sliding nut 70 or 80 and the bar 18, if desired. Also, a different complementary fit between the sliding nut 70 or 80 and the base member 12 may be utilized.

Figure 13:
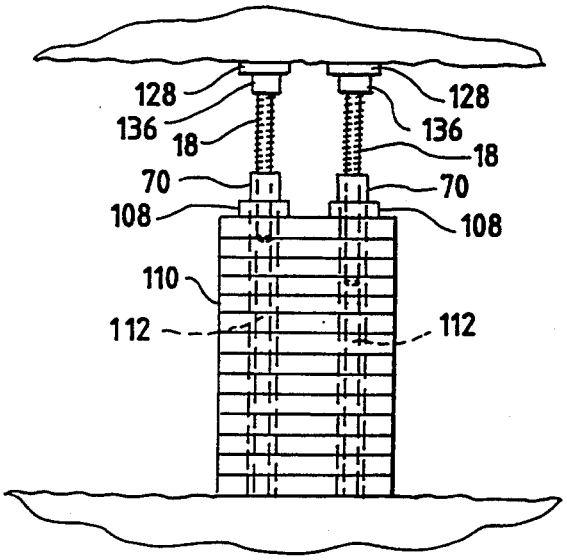
FIG. 13 comprises an elevational view of yet another embodiment of the present invention.

It should be noted that the sliding nut 70 or 80 and the rod 18 may be supported by any other structure having an opening or aperture therethrough to permit travel of the rod 15. In any case, the support structure is preferably capable of carrying a load in excess of the breaking load limit of the bar 18. Thus, for example, FIG. 13 illustrates an alternative embodiment of the present invention wherein the support of FIGS. 11 and 12 may be used together with conventional wooden cribbings or concrete donuts to yieldably support a load. The embodiment of FIG. 13 provides greater resistance against buckling as compared with the embodiment of FIGS. 11 and 12. More specifically, one or more threaded bars 18 are disposed within one or more sliding nuts 70 or 80 that are in turn disposed atop collars 108. A series of wooden cribbings or concrete donuts 110 are stacked beneath the bars 18, the sliding nut 70 or 80 and the collars 108 and include aligned apertures or bores 112 therein. Disposed atop the bars 18 are top plates 128 secured to the bars 18 by nuts 136 welded thereto.

As a roof load is applied to the bars 18 atop the plates 128, the sliding nuts 70 or 80 shear threads on the bars 18, as before. The bars 18 thus extend into the bores 112 in the cribbings or donuts 110.

The embodiment of FIG. 13 has the advantage in that only a relatively short length of bar 18 is needed and a high yielding path is provided.

It should be noted that multiple supports according to the present invention can be used together and joined between a common top plate and bottom plate to form a multiple unit for supporting a compressive load.

Figure 14:
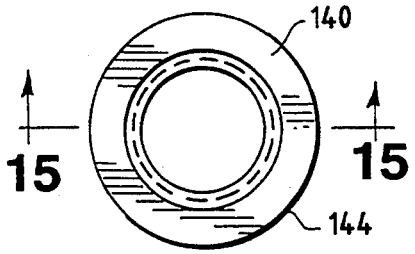
FIG. 14 comprises a plan view of a further mandrel useful in an alternative embodiment of the present invention.
Figure 15:
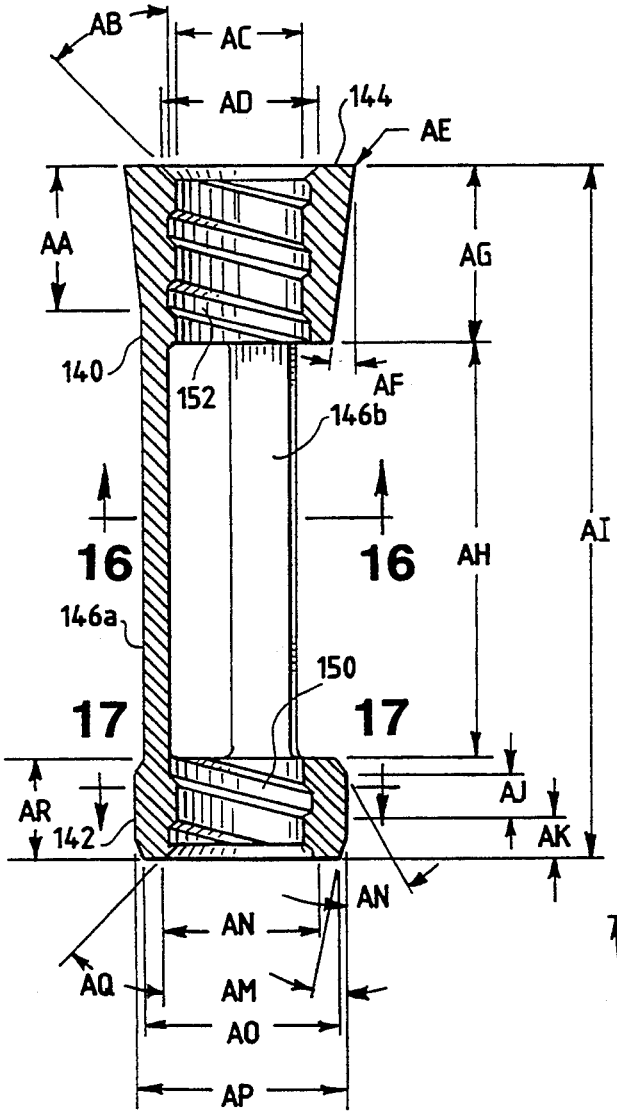
FIG. 15 comprises a .sectional view taken generally along the lines 15—15 Qf FIG. 14.
Figure 16:
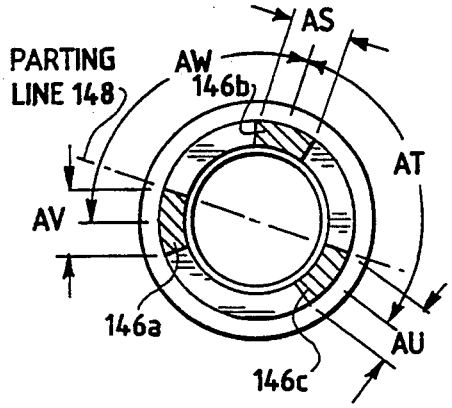
FIGS. 16 and 17 are sectional views taken generally along the lines 16—16 and 17—17, respectively, of FIG. 15.
Figure 17:
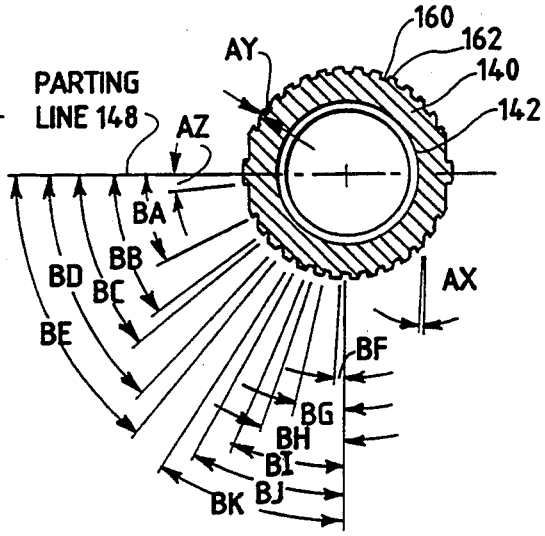
Figure 18:
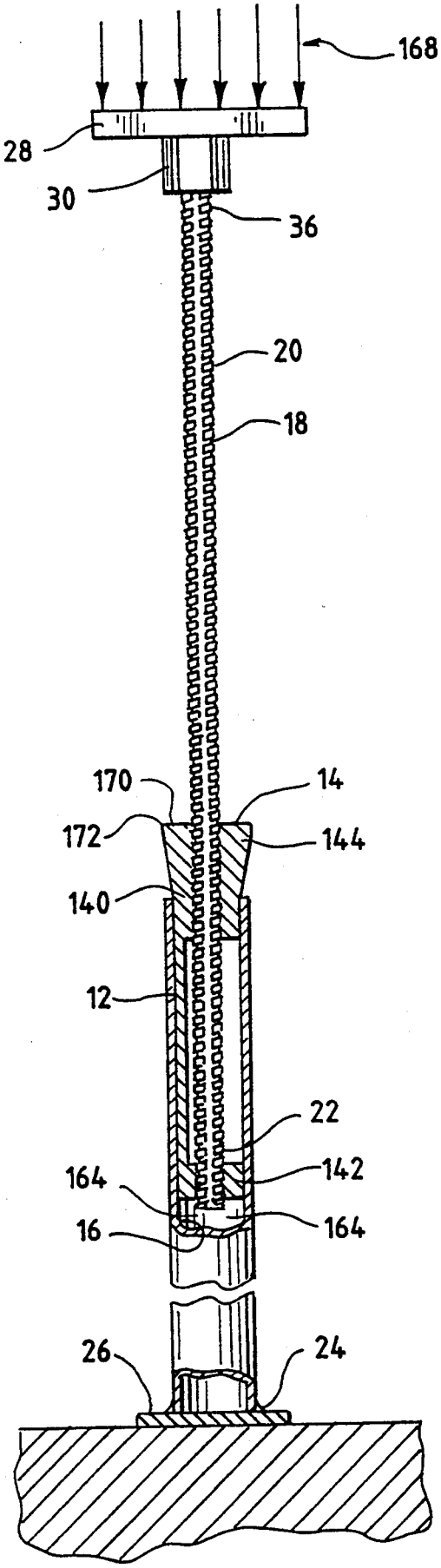
FIG. 18 comprises an elevational view, partly in section, of an alternative embodiment of the present invention.

FIGS. 14–18 illustrate yet another alternative embodiment of the present invention wherein the mandrel 40 and cylindrical nut 60 are replaced by a centralizing mandrel 140. As seen in FIGS. 14, 16 and 17, the centralizing mandrel 140 is circular in cross-section and includes a cylindrical body or centralizer portion 142 joined to a mandrel portion 144 by a series of three axial connecting members or struts **146*a*–146*c*. Preferably, the centralizing mandrel 140 is cast as an integral part and the parting line 148 of a mold (not shown) for producing the centralizing mandrel 140 is shown in FIGS. 16 and 17 to assist in orientation. The centralizer portion 142 and the mandrel portion 144 include internal threads 150, 152, respectively, which are aligned such that they would form a continuous helix if the threads were of sufficient lengths to meet. The threads are also of a shape and pitch to permit threading of the centralizing mandrel 140 onto the bar 18**.

The centralizer portion 142 has an outer diameter slightly larger than the inner diameter of the base member 12. The centralizer portion 142 further includes grooves 160 formed in an outer surface 162 thereof.

The roof support is prepared for shipment to a mine by threading the centralizing mandrel 140 onto the bar 18 either from the top before the bar is threaded into the nut 30 or from the bottom, following which a portion of the thread is upset or a tab (not shown) is welded to the bar to prevent removal of the centralizing mandrel 140. A lubricant, such as oil, is applied to an inner wall 164 defining the interior 16 of the base member 12. An end 166 of the bar 18 and the centralizing mandrel 140 are then inserted through the open end 14 of the base member 12 into the interior 16. Force is applied in the direction of the arrows 168 to in turn force the centralizer portion 142 and thereafter the mandrel portion 144 into the base member 12. Total removal of lubricant from the inner wall 164 by the centralizer portion 142 is prevented by the grooves 160 so that lubricant is available on the inner wall 164 to assist in providing a substantially constant force as the mandrel portion 144 is forced into the base member 12. Preferably, although not necessarily, the centralizing mandrel 140 is inserted into the base member 12 until an upper face 170 of the mandrel 140 is substantially flush with an upper edge 172 of the base member 12. By assembling the components in this fashion and by forming the centralizer portion with an outer diameter slightly larger than the inner diameter of the base member 12, the roof support can be shipped as a unit without loose parts to the mine. Thereafter, the bar 18 may be unscrewed so that the upper plate 28 and the lower plate 26 are in contact With the roof and the floor, respectively, of the mine. As noted previously, unthreading of the bar 18 from the centralizer portion 142 is prevented by the upsetting of the threads or provision of a tab thereon.

Another advantage of this assembly procedure is that, as the centralizing mandrel 140 and the bar 18 are forced into the base 12, readings of the force required to undertake this insertion can be obtained and a measure of the capacity of the roof support can thereby be obtained.

In one example of this embodiment of the present invention, the various parts illustrated in FIGS. 14–18 have the dimensions indicated in Table B below, although it should be noted that the following dimensions are optional and are not to be construed as limiting the scope of the present invention (reference letters are indicated in the Figures and all dimensions are in inches unless otherwise indicated). Elements common to FIGS. 1–13 and 18 have like reference numerals and identical dimensions.

TABLE B

| Reference Letter | Dimension |
|---|---|
| AA | 2.444 |
| AB | 45.0 degrees |
| AC | 02.288 |
| AD | 02.750 |
| AE | 0.100 radius |
| AF | 8. degrees |
| AG | 3.000 |
| AH | 7.250 |
| AI | 12.000 |
| AJ | .750 |
| AK | .666 |
| AL | 30.0 degrees |
| AM | 10.5 degrees |
| AN | 02.750 |
| AO | 03.423 |
| AP | 03.670 |
| AQ | 45.0 degrees |
| AR | 1.750 |
| AS | 1.000 |
| AT | 109.0 degrees |
| AU | 1.100 |
| AV | 1.100 |
| AW | 109.0 degrees |
| AX | 3.0 degrees |
| AY | 0.094 |
| AZ | 5.0 degrees |
| BA | 25.0 degrees |
| BB | 35.0 degrees |
| BC | 38.0 degrees |
| BD | 46.0 degrees |
| BE | 50.0 degrees |
| BF | 3.0 degrees |
| BG | 13.0 degrees |
| BH | 19.0 degrees |
| BI | 23.0 degrees |
| BJ | 29.0 degrees |
| BK | 33.0 degrees |

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within thee scope of the appended claims is reserved.

We claim:

1. A support, comprising:

a base member having an open end and an inner wall of a first cross-sectional size defining a hollow interior;

a forcing member having an end extending through the open end of the base member into the hollow interior thereof and having threads thereon; and a further member having a portion of a second cross-sectional size larger than the first cross-sectional size and capable of engaging the threads of the forcing member at an adjustable position wherein the portion is movable into the interior of the base member for expanding the inner wall outwardly at a point of contact of the portion with the inner wall of the base member as a compressive load is applied to the forcing member.

2. The support of claim 1, wherein the further member comprises a tapered mandrel having a threaded bore therethrough in engagement with the threads on the forcing member.

3. The support of claim 2, wherein the mandrel and the base member are circular in cross-section, the base member has an inner diameter of a first size throughout its length and the mandrel has an outer diameter of a second size less than the first size at another end thereof.

4. The support of claim 3, wherein the outer diameter of the mandrel increases linearly from the second size to a third size over a portion of its length.

5. The support of claim 1, further including means carried by the forcing member and disposed within the base member for centering the forcing member as relative movement occurs between the members in response to application of load thereto.

6. The support of claim 5, further including means for connecting the further member to the centering means.

7. The support of claim 6, wherein the further member comprises a tapered mandrel having a threaded bore therethrough in engagement with the threads on the forcing member, the centering means comprises a cylindrical member and the connecting means comprises an axial member.

8. The support of claim 6, wherein the centering means includes an outer surface having an outer diameter larger than an inner diameter of an inner wall of the base member and a lubricant is disposed on the inner wall and wherein the centering means further includes axial grooves in the outer wall thereof that prevent portions of the lubricant from being removed from the inner wall as the relative movement between the members occurs.

9. The support of claim 5, wherein the centering means comprises a cylindrical nut disposed on the threads of the forcing member.

10. The support of claim 1, wherein the forcing member comprises a threaded bar.

11. The support of claim 1, wherein the base member comprises a pipe which is radially expanded by the further member during relative movement of the members.

12. A roof support for a mine, comprising:

a pipe having first and second ends and a wall defining a channel therethrough of circular cross-section having a substantially constant diameter over its length;

a bar having first and second ends and threads about an outer periphery thereof;

a mandrel having a threaded bore therethrough in engagement with the threads on the bar whereby the mandrel may be positioned at a desired point on the bar by turning the mandrel relative to the bar, the mandrel further including an outer surface of first diameter smaller than the substantially constant diameter at a first end thereof and of second diameter larger than the substantially constant diameter at a second end thereof opposite the first end;

wherein the first end of the bar extends through the first end of the pipe and the mandrel is disposed at least partially within the pipe channel such that the outer surface thereof is in interfering contact with the walls of the pipe and wherein the second end of the mandrel is moved into the pipe and the pipe wall is deformed radially outwardly at a point of contact of the second end of the mandrel with the pipe wall when a load of a certain magnitude is applied to the bar; and top and bottom plates disposed on the second ends of the bar and pipe, respectively, and adapted to engage a roof and a floor, respectively, of a mine.

13. The roof support of claim 12, further including a cylindrical nut carried by the bar and disposed within the pipe channel for centering the bar as relative movement occurs between the bar and pipe in response to application of load thereto.

14. The roof of claim 12, wherein support the mandrel includes a longitudinal axis and the mandrel outer surface includes an intermediate tapered portion of uniformly increasing diameter and disposed at a certain angle with respect to the longitudinal axis.

15. The roof support of claim 14, wherein the certain angle is within a range between 7 and 15 degrees.

16. The roof support of claim 15, wherein the certain angle is equal to 10.5 degrees.

17. The roof support of claim 12, wherein the substantially constant diameter is equal to 3.548 inches and the second diameter is equal to 4.535 inches.

18. The roof support of claim 17, wherein the first diameter is equal to 3.423 inches.

19. The roof support of claim 12, further including a cylindrical member disposed within the pipe and having an outer diameter larger than an inner diameter of an undeformed portion of the pipe wherein the cylindrical member centers the bar as relative movement occurs between the bar and pipe in response to application of load thereto and an axial member connecting the cylindrical member to the mandrel.

20. The roof support of claim 19, wherein a lubricant is applied to the walls of the pipe and wherein the cylindrical member includes axial grooves in an outer surface thereof that prevent portions of the lubricant from being removed from the inner wall as relative movement between the bar and pipe occurs.

21. A roof support for a mine, comprising:

a support structure having a support surface and an aperture therethrough;

a bar having first and second ends and a projection about an outer periphery thereof, the projection having a first shear strength;

a sliding nut having a bore therethrough and having a portion in engagement with the projection on the bar whereby the portion of the sliding nut has a second shear strength greater than the first shear strength;

wherein the first end of the bar extends into the aperture and the sliding nut is disposed in contact with the support surface of the support structure; and top and bottom plates disposed on the second ends of the bar and support structure, respectively, and adapted to engage a roof and a floor, respectively, of a mine whereby loads applied to the top and bottom plates place the bar and support structure in compression.

22. The roof support of claim 21, wherein the support structure comprises a pipe.

23. The roof support of claim 22, further including a cylindrical nut carried by the bar and disposed within the channel for centering the bar as relative movement occurs between the bar and pipe.

24. The roof support of claim 21, wherein the support structure comprises wooden cribbings.

25. The roof support of claim 21, wherein the support structure comprises concrete donuts.

26. The roof support of claim 21, wherein the projection on the bar comprises a series of threads and wherein the threads are sheared off the bar as relative movement occurs between the bar and support structure system in response to application of a compressive load thereto.

27. The roof support of claim 21, wherein the sliding nut and the support surface are complementarily shaped to assist in centering of the bar.

28. The roof support of claim 21, further including means for limiting relative movement of the bar and support structure.

29. The roof support of claim 28, wherein the limiting means comprises a nut carried by the bar.

* * * * *